United States Patent [19]

Lastovich

[11] Patent Number: 4,725,465

[45] Date of Patent: Feb. 16, 1988

[54] WATER-SOLUBLE PACKET FOR CONTAINING CHEMICAL SPILLS

[75] Inventor: Mark S. Lastovich, Rockford, Mich.

[73] Assignee: Oliver Products Company, Grand Rapids, Mich.

[21] Appl. No.: 893,038

[22] Filed: Aug. 1, 1986

[51] Int. Cl.[4] ..... B27N 5/02; B32B 1/04; B32B 3/00; B65D 81/26

[52] U.S. Cl. ..... 428/35; 428/76; 428/200; 428/201; 428/210; 206/204; 206/524.7; 426/124

[58] Field of Search ..... 428/35, 76, 200, 201, 428/210; 206/204, 524.7; 426/124

[56] References Cited

U.S. PATENT DOCUMENTS

| | | | |
|---|---|---|---|
| 2,902,395 | 9/1959 | Hirschy et al. . | |
| 3,616,797 | 11/1971 | Champaigne, Jr. et al. . | |
| 3,636,952 | 1/1972 | George . | |
| 3,670,731 | 6/1972 | Harmon . | |
| 3,862,963 | 1/1975 | Hoshi et al. . | |
| 3,881,210 | 5/1975 | Drach et al. . | |
| 3,892,905 | 7/1975 | Albert | 428/220 |
| 3,904,528 | 9/1975 | Yocum . | |
| 3,932,322 | 1/1976 | Duchane . | |
| 3,965,519 | 6/1976 | Hermann . | |
| 4,031,839 | 6/1977 | Pedone . | |
| 4,076,663 | 2/1978 | Masuda et al. . | |
| 4,107,051 | 8/1978 | Lorentzen . | |
| 4,124,116 | 11/1978 | McCabe, Jr. . | |
| 4,213,528 | 7/1980 | Kreutz et al. . | |
| 4,276,338 | 6/1981 | Ludwa et al. . | |
| 4,287,251 | 9/1981 | King et al. . | |
| 4,355,066 | 10/1982 | Newman . | |
| 4,381,784 | 5/1983 | Aberson et al. . | |
| 4,401,475 | 8/1983 | Eriksson et al. . | |
| 4,435,178 | 3/1984 | Fitzgerald . | |
| 4,497,712 | 2/1985 | Cowling | 210/691 |
| 4,613,538 | 9/1986 | Wendell et al. | 428/198 |

OTHER PUBLICATIONS

"Health Care Packaging", published by Oliver Products Company, undated.

"Oliver's Unique Dot Pattern Adhesive Coating Provides Excellent Lid Porosity for Improved Sterilization Efficiency" by Oliver Products Company, undated.

*Primary Examiner*—John E. Kittle

*Assistant Examiner*—Patrick J. Ryan

*Attorney, Agent, or Firm*—Price, Heneveld, Cooper, DeWitt & Litton

[57] ABSTRACT

The specification discloses a disposable packet containing a substance to be released upon subjection of the packet to water. The pouch includes a water-soluble paper envelope with the substance sealed therein. The interior surfaces of the envelope are coated with adhesive in a discontinuous or disconnected pattern, so that the adhesive does not significantly impede dissolution of the envelope. The adhesive is activated in selected areas to seal the envelope.

24 Claims, 3 Drawing Figures

FIG. 1
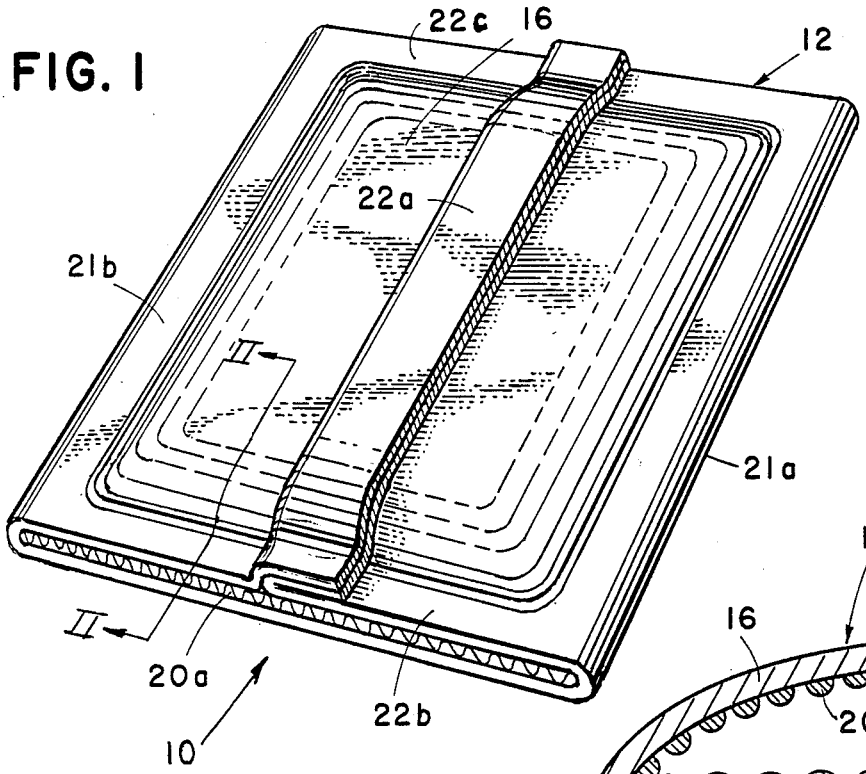
FIG. 2
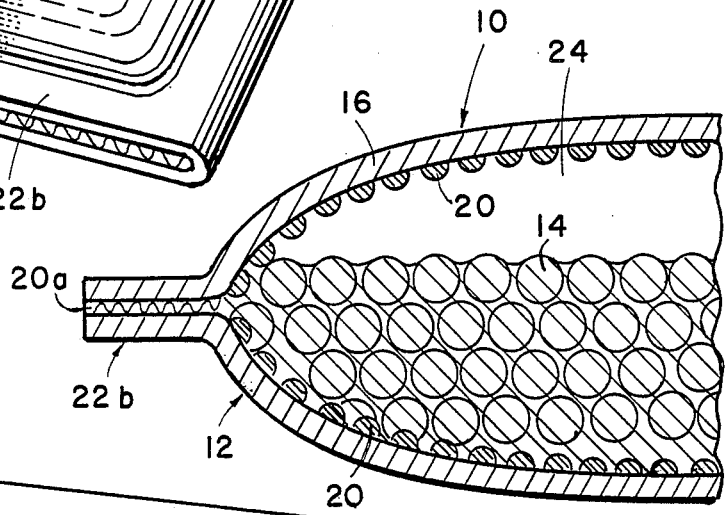
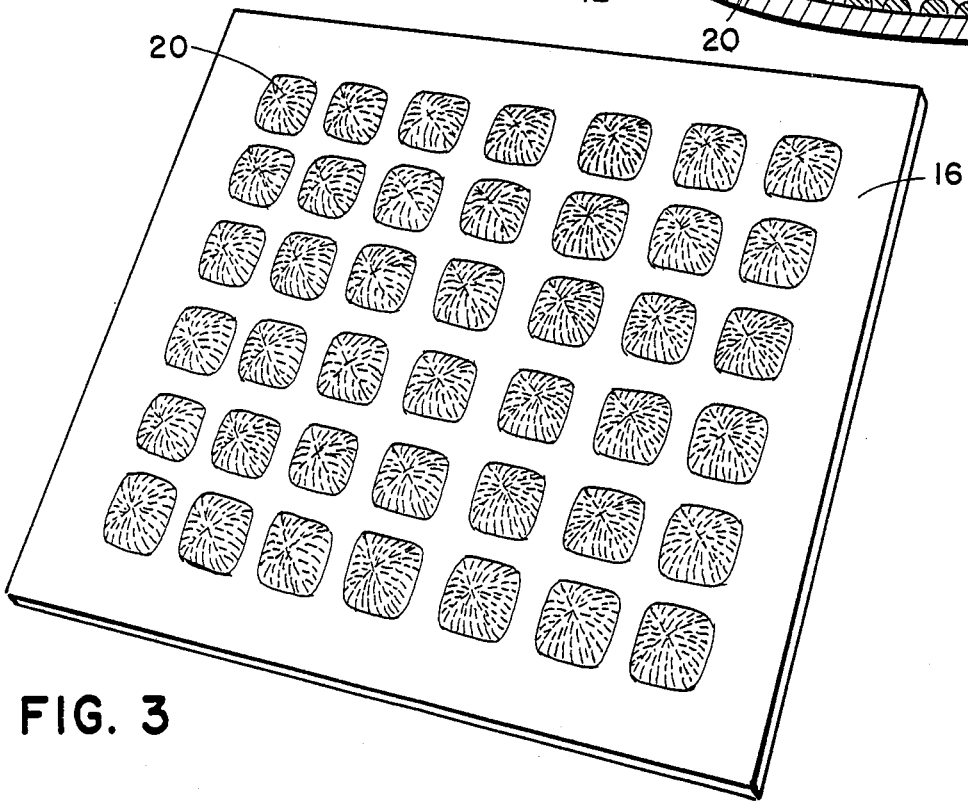
FIG. 3

WATER-SOLUBLE PACKET FOR CONTAINING CHEMICAL SPILLS

BACKGROUND OF THE INVENTION

The present invention relates to a device and method for containing chemical spills, and more particularly to a water-soluble envelope having a chemical-immobilizing reagent therein.

Spilled toxic and other contaminating chemicals must be contained to prevent or impede those chemicals from entering desired environments. A wide variety of reagents has been developed to immobilize spilled chemicals by absorption, gelling, or thickening. The reagents are introduced onto or about the spilled chemicals in a variety of ways including disposable packets.

One such disposable packet is manufactured by Multiform Desiccants, Inc., of Buffalo, N.Y. and includes a sealed envelope enclosing a chemical-immobilizing reagent. The envelope is fabricated of a starch paper having a continuous gum adhesive coating thereon. The adhesive can be either moisture or heat-activated in selected areas to seal the envelope. The gum adhesive and the starch paper are both water-soluble and, therefore, disintegrate when subjected to a spilled chemical including water. Upon dissolution of the envelope, the reagent is released to immobilize the spilled chemical. Tests have shown that the Multiform packet requires approximately one minute and fifteen seconds to one minute and forty-five seconds to dissolve completely. This dissolution time is undesirably slow in many situations.

SUMMARY OF THE INVENTION

The present invention vastly increases the speed at which the water-soluble envelope dissolves. More particularly, the present reagent packet includes a sealed pouch and a chemical-immobilizing reagent contained therein. The pouch is at least partially fabricated of a water-soluble substrate coated over substantially its entire surface with adhesive in a discontinuous or disconnected pattern. In one preferred embodiment of the invention, the disconnected pattern is a rectangular grid of dots. The discontinuity of the adhesive permits the water-soluble substrate to dissolve rapidly, because the adhesive does not attempt to hold the dissolving substrate together.

Tests have shown that the packet of the present invention completely disintegrates in approximately ten seconds, which is approximately seven to ten times faster than the packets of the prior art. Consequently, the present reagent package immobilizes or otherwise contains spilled chemicals far more quickly than packets presently available.

The unexpected and surprising results and benefits produced by the present invention arose from the utilization of an adhesive application pattern from an unrelated field to the present field. Oliver Products Company, the assignee of the present invention, has long manufactured and sold a medical packaging material including a nonwoven synthetic (i.e., nondissolvable) substrate coated with adhesive in a dot or grid pattern. This adhesive pattern permits air flow through the substrate during sterilization of instruments within the medical packaging to enhance both the speed and effectiveness of sterilization.

In attempting to determine what adhesive coatings are suitable for use in packets of the present type, the dot pattern was applied to a water-soluble paper. As a total surprise both to the inventor and others having skill in the art, the resultant product dissolves far more rapidly than the continuously coated substrates previously used.

These and other objects, advantages, and features of the invention will be more readily understood and appreciated by reference to the detailed description of th preferred embodiment and the drawings.

BRIEF DESCRIPTION OF THE DRAWINGS

FIG. 1 is a perspective view of the packet of the present invention;

FIG. 2 is a fragmentary sectional view taken along line II—II in FIG. 1; and FIG. 3 is a highly magnified view of the adhesive-coated substrate used in making the packet.

DETAILED DESCRIPTION OF THE PREFERRED EMBODIMENT

A water-soluble reagent packet constructed in accordance with a preferred embodiment of the invention is illustrated in FIGS. 1 and 2 and generally designated 10. The packet includes a sealed envelope 12 and a reagent 14 contained therein. The envelope is fabricated of a single sheet 16 of a water-soluble paper or other substrate. The interior surface of the sheet is coated with adhesive 20 in a grid or dot pattern. The adhesive is activated in areas 22 to seal the sheet 16 into an envelope and confine the reagent within the envelope.

The substrate from which the envelope 12 is fabricated is "soluble". Although this term is not known to have a commonly accepted definition in this art, "soluble" as used herein means susceptible to being dissolved in a given liquid and includes any substrate specifically designed to dissolve upon contact with the liquid and/or any substrate which actually totally dissolves within 30 seconds when immersed in the liquid. A material is rapidly soluble if total dissolution occurs within 10 seconds.

In the preferred embodiment, the substrate is a water-soluble paper sold under the registered trademark DISSOLVO by Gilbreth International Corp. of Bensalem, Pa. Water as used herein means all commonly occurring aqueous forms such as distilled water, tap water, sea water, and the like. DISSOLVO paper is available in a variety of grades and weights. Two types which have been used in conjunction with the present invention are DISSOLVO No. 2845, which is 0.0035 inch thick and has a basis weight of 32.6 pounds (using a 3,000 square foot basis), and DISSOLVO No. 2800, which is also 0.0035 inch thick with a basis weight of 40.5 pounds. The DISSOLVO paper dissolves in five seconds in water having a temperature of 68 degrees F and dissolves practically "instantaneously" in water having a temperature of 122 degrees F. Of course, other water-soluble substrates may be substituted for the disclosed materials. Suitable water-soluble papers generally known to the art are referred to as "starch papers". The particular substrate selected depends on the strength requirements of the specific application.

The substrate 16 (FIG.) is coated with adhesive 20 in a discontinuous or disconnected pattern. As used herein, "discontinuous" means any pattern wherein areas of adhesive are separated by noncoated areas; and "disconnected" means any discontinuous pattern wherein areas of adhesive form islands completely surrounded by uncoated areas. The preferred adhesive pattern illustrated in FIG. 3 is therefore both discontinuous and disconnected. Disconnected patterns provide the more rapid dissolution of the substrate and are therefore preferred. However, discontinuous patterns also provide rapid, albeit slower, rates of dissolution and are within the scope of the present invention.

Preferably, the adhesive 20 is a heat-sealable thermoplastic, also known as a "hot melt". These adhesives are nontacky at room temperature to prevent the substrate from adhering to itself and to eliminate the need for "release liners" as would be necessary with pressure-sensitive adhesives. At elevated temperatures in the range of 185 degrees F., the adhesive becomes instantaneously tacky enabling adhesion between two contacting substrates. The substrates are bonded together as the substrates and adhesive cool.

The adhesive 20 is applied in a rectangular grid of dots or islands, each of which is completely surrounded by uncoated area (FIG. 3). The adhesive is preferably applied using a gravure coating method. Alternative methods such as screen-coating, spray-coating, powder-coating, and transfer-coating can also be used. In the preferred embodiment, the rectangular grid includes 15 to 150 lines or dots per inch, and most preferably 55 lines or dots per inch, as measured on the diagonal. The minimum amount of uncoated area is preferably approximately 20% of the total substrate surface, while the maximum uncoated area is preferably approximately 50% of the substrate surface. The amount of uncoated area depends on the effectiveness of the adhesive transfer from the gravure roller or other coater to the substrate. The adhesive is applied at a preferred rate of six to fourteen pounds per three thousand square feet (i.e. per basis).

The envelope 12 is formed from a single sheet 16 of the water-soluble paper. The sheet 16 is folded along lines 21*a* and *b;* the resultant overlying edge portions 22*a* are sealed to form a longitudinal fin seal; and the opposite end portions 22*b* and *c* are also sealed. All seals are formed by heat-activating the adhesive in the desired areas. The seals prevent the contents of the package from escaping through the sealed interface. As illustrated in FIG. 2, the activated adhesive 20*a* at the seals runs together and fuses the sheet to itself. Alternatively, the envelope can be formed of two sheets overlying one another and sealed along the entire peripheral edge.

The resultant envelope defines a void or chamber 24 in which the reagent-14 is contained. As illustrated in FIG. 2, the adhesive 20 remains undistorted within the chamber 24. The reagent can be any substance selected to partially immobilize a desired spilled chemical. "Immobilizing" as used herein includes absorbing, gelling, or thickening a chemical. Typical immobilizing agents include carboxymethyl cellulose, alpha cellulose, fumed silica, and gum arabic.

Packet Manufacture and Use

It is currently envisioned that the packets will be manufactured by first forming a tube using a single running sheet of the coated substrate stock. The tube will be formed by folding the sheet upon itself along lines 21*a* and *b* with the adhesive facing inwardly and then heat-sealing the adhesive at the longitudinal overlapping edges 22*a* to form a fin seal. Blanks of the desired envelope size will be severed from the running tube, and the bottom edge 22*b* will also be heat-sealed. The reagent 14 will be introduced into the envelope 12 to at least partially fill the chamber 24. Finally, the top edge 22*c* of the envelope will be heat-sealed to completely enclose the reagent.

The discontinuous and/or disconnected adhesive pattern does not provide significant structural strength to the substrate, permitting total disintegration of the soluble substrate when subjected to the dissolving liquid such as water. It is believed that the disconnected pattern does not attempt to hold the dissolving substrate togethe and therefore permits the substrate to break up relatively rapidly. This is in sharp contrast to prior packets wherein the continuous adhesive coating is believed to attempt to hold the substrate together and impede dissolution. As noted above, the packet of the present invention dissolves approximately seven to ten times faster than the packages of the prior art.

The present packet can be used in a variety of ways to contain spilled chemicals. As a preventive or precautionary measure, the packets can be placed in secondary containers such as shipping cases to immobilize fluids lost from broken or damaged primary containers such as bottles or cans. As an after-spill measure, the packets can be placed in or surrounding a spilled chemical to control flow and/or spreading.

The present coated substrate, and envelopes constructed thereof, can also be used to create other water-soluble packets, for example packets containing laundry detergents, softeners, or other agents. It is also possible that other container means for containing the reagent can be fabricated using the soluble substrate, such as a plastic tray lidded with the coated substrate.

The above description is that of a preferred embodiment of the invention. Various changes and alterations can be made without departing from the spirit and broader aspects of the invention as set forth in the appended claims which are to be interpreted in accordance with the principles of patent law including the doctrine of equivalents.

The embodiments of the invention in which an exclusive property or privilege is claimed are defined as follows:

1. A method of forming a product for at least partially immobilizing a spilled liquid, the method comprising the steps of:

applying adhesive in a discontinuous pattern over substantially the entire surface of a water-soluble paper;

forming an envelope from the paper with the adhesive lining the interior of the envelope;

at least partially filling the envelope with a material which immobilizes the spilled liquid when contacted therewith; and activating the adhesive as necessary to seal the material within the envelope.

2. A method as defined in claim 1 wherein, prior to said applying step, the paper is rapidly water-soluble providing complete dissolution with 10 seconds or less.

3. A method as defined in claim 1 wherein the adhesive is applied in a disconnected pattern wherein each area of adhesive is an island surrounded by an uncoated area.

4. A method as defined in claim 3 wherein said adhesive is applied in a dot pattern.

5. A method as defined in claim 1 wherein the container is formed from a single sheet of the paper.

6. A method of packaging a substance for subsequent release upon subjection to a liquid comprising the steps of:

forming a container at least partially from a substrate which is soluble in the liquid and which is coated on at least one side throughout substantially its entire length and width with an adhesive in a discontinuous pattern;

at least partially filling the container with the substance; and activating the adhesive as necessary to close the container and seal the substance therein.

7. A method as defined in claim 6 wherein the uncoated substrate is rapidly soluble in the liquid to be completely dissolved upon immersion therein within 10 seconds or less.

8. A method as defined in claim 7 wherein the liquid is water.

9. A method as defined in claim 6 wherein the substrate is coated with adhesive in a disconnected pattern such that each area of adhesive is an island.

10. A method as defined in claim 9 wherein the islands are applied in a grid pattern.

11. A reagent packet comprising: an envelope fabricated of a water-soluble paper, the interior surface of said envelope being coated with adhesive in a discontinuous pattern, said adhesive extending substantially the full extent of said interior surface, said adhesive activated as necessary to seal said envelope; and a reagent within said envelope, said reagent being capable of reacting with a spilled chemical to at least partially immobilize the spilled chemical.

12. A reagent packet as defined in claim 11 wherein the uncoated paper is rapidly soluble providing complete dissolution in 10 seconds or less.

13. A reagent packet as defined in claim 11 wherein said adhesive is in a disconnected pattern so that each area of adhesive is an island on said substrate.

14. A reagent packet as defined in claim 13 wherein said adhesive is in a grid pattern.

15. A liquid-soluble packet comprising:

container means for containing a substance, said container means including at least one adhesive-coated liquid-soluble sheet having an inner surface facing the interior of said container means, said sheet being coated over substantially its entire inner surface with adhesive in a discontinuous pattern, said adhesive securing said sheet to the remaining portion of said container means to seal said container means; and a substance within said sealed container means to be released upon subjection of said packet to a liquid.

16. A soluble packet as defined in claim 15 wherein said sheet is a rapidly soluble paper.

17. A soluble packet as defined in claim 15 wherein said adhesive forms a disconnected pattern, whereby each area of adhesive is an island on said sheet.

18. A soluble packet as defined in claim 17 wherein said disconnected pattern is a grid pattern.

19. A soluble packet as defined in claim 15 wherein said container means is formed exclusively of said adhesive-coated sheets.

20. A method as defined in claim 3 wherein the adhesive is applied to approximately 50 percent to approximately 80 percent of the paper surface.

21. A method as defined in claim 9 wherein the adhesive is coated on approximately 50 percent to approximately 80 percent of the one side of the substrate.

22. A method as defined in claim 9 wherein the substrate is a paper.

23. A reagent packet as defined in claim 13 wherein the uncoated area is approximately 20 percent to approximately 50 percent of the interior substrate surface.

24. A soluble packet as defined in claim 17 wherein the uncoated area is approximately 20 percent to approximately 50 percent of said inner surface of said sheet.

* * * * *

UNITED STATES PATENT AND TRADEMARK OFFICE

CERTIFICATE OF CORRECTION

PATENT NO. : 4,725,465

DATED : February 16, 1988

INVENTOR(S) : Mark S. Lastovich

It is certified that error appears in the above-identified patent and that said Letters Patent is hereby corrected as shown below:

Column 2, Line 63:
"(Fig.)" should be --(Fig. 3)--.

Column 4, Line 11:
"togethe" should be --together--.

Column 4, Line 60:
"with" should be --within--.

Signed and Sealed this

Thirty-first Day of January, 1989

*Attest:*

DONALD J. QUIGG

*Attesting Officer*

*Commissioner of Patents and Trademarks*